US010647485B2

(12) United States Patent
Presche

(10) Patent No.: US 10,647,485 B2
(45) Date of Patent: May 12, 2020

(54) CLOSURE DEVICE FOR A CONTAINER

(71) Applicant: RPC Bramlage GmbH, Lohne (DE)

(72) Inventor: Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 152 days.

(21) Appl. No.: 15/556,164

(22) PCT Filed: Feb. 10, 2016

(86) PCT No.: PCT/EP2016/052759
§ 371 (c)(1),
(2) Date: Sep. 26, 2017

(87) PCT Pub. No.: WO2016/128420
PCT Pub. Date: Aug. 18, 2016

(65) Prior Publication Data

US 2018/0044080 A1 Feb. 15, 2018

(30) Foreign Application Priority Data

Feb. 11, 2015 (DE) ..... 10 2015 101 961

(51) Int. Cl.
*B65D 51/28* (2006.01)
*B65D 41/28* (2006.01)

(52) U.S. Cl.
CPC ..... *B65D 51/2892* (2013.01); *B65D 41/28* (2013.01); *B65D 2251/0015* (2013.01); *B65D 2251/0093* (2013.01)

(58) Field of Classification Search
CPC .... B65D 51/2892; B65D 41/28; B65D 51/28; B65D 51/2807; B65D 81/3266;
(Continued)

(56) References Cited

U.S. PATENT DOCUMENTS 3,404,811 A 10/1968 Cernei
4,140,235 A * 2/1979 Rausing ..... B65D 39/08 215/305

(Continued)

FOREIGN PATENT DOCUMENTS

CN 102785846 A 11/2012
DE 10 2004 034 709 B3 2/2006

(Continued)

OTHER PUBLICATIONS

International Search Report of PCT/EP2016/052759, dated Sep. 27, 2016.

*Primary Examiner* — Steven A. Reynolds
(74) *Attorney, Agent, or Firm* — Collard & Roe, P.C.

(57) ABSTRACT

A closure device for a container opening includes a lid element for closing the container opening, a chamber which is arranged on the lid element, and an inner housing. The chamber and the inner housing have corresponding closure means and opening means as well as corresponding first threaded means. A discharge opening paired with the chamber can be released with the aid of the threaded means by moving the lid element relative to the inner housing such that a medium stored in the chamber can exit into the container. The chamber has a first region above the first threaded means and a second region below the first region, wherein, relative to an axis of rotation of the thread, the first region is designed radially greater than the second region.

10 Claims, 13 Drawing Sheets

(58) Field of Classification Search
CPC ..... B65D 81/3272; B65D 51/2857; B65D 2251/0093; B65D 2251/0015
USPC ..... 206/221, 219
See application file for complete search history.

(56) References Cited

U.S. PATENT DOCUMENTS 5,419,445 A * 5/1995 Kaesemeyer ..... A61J 1/2093 206/220
5,465,835 A * 11/1995 Schumacher ..... B65D 51/2885 206/219
7,055,685 B1 6/2006 Patterson et al.
7,210,575 B2 * 5/2007 Oswald ..... B65D 51/2885 206/219
7,886,899 B2 2/2011 Frutin
8,672,156 B2 * 3/2014 Martinovic ..... B65D 51/28 215/227
2002/0185389 A1 12/2002 Kelders et al.
2003/0213709 A1 * 11/2003 Gibler ..... B65D 51/2842 206/219
2005/0016875 A1 * 1/2005 Rodriguez ..... B65D 51/2814 206/219
2005/0211579 A1 * 9/2005 Makita ..... B65D 51/2842 206/219
2008/0035599 A1 2/2008 Seibel
2008/0314775 A1 * 12/2008 Owoc ..... B65D 25/08 206/222
2009/0114615 A1 5/2009 Joubert et al.
2009/0236244 A1 * 9/2009 Frutin ..... B65D 51/2892 206/219
2012/0024862 A1 2/2012 Otsuka et al.
2014/0110281 A1 * 4/2014 Chen ..... B65D 51/2892 206/219
2014/0305817 A1 10/2014 Guery et al.

FOREIGN PATENT DOCUMENTS

EP 0 520 207 A1 12/1992
EP 2 423 124 A1 2/2012
WO 99/01354 A1 1/1999
WO 2007/129116 A1 11/2007

* cited by examiner

CLOSURE DEVICE FOR A CONTAINER

CROSS REFERENCE TO RELATED APPLICATIONS

This application is the National Stage of PCT/EP2016/052759 filed on Feb. 10, 2016, which claims priority under 35 U.S.C. § 119 of German Application No. 10 2015 101 961.2 filed on Feb. 11, 2015, the disclosures of which are incorporated by reference. The international application under PCT article 21(2) was not published in English.

AREA OF TECHNOLOGY

The invention relates to a closure device for a container, in particular a glass container, with a container opening, wherein the closure device has a lid element for closing the container opening, a chamber arranged on the lid element and an inner housing, wherein the chamber and inner housing have mutually corresponding closure means and opening means, which interact with each other in such a way that a discharge opening allocated to the chamber can be released by moving the lid element relative to the inner housing, so that a medium stored in the chamber can exit into the container, and the chamber and inner housing each have corresponding first threads formed relative to a rotational thread axis.

PRIOR ART

Closure devices of the aforementioned kind are known in prior art. The latter are used to seal containers, for example a beverage bottle, and simultaneously provide a chamber for separately storing liquid or powder ingredients, for example tea essences, so that the latter do not come into direct contact and/or become mixed with the content of the container, i.e., water, in the filling process, but rather only at the moment when the closure device is removed from the container. This is routinely the moment at which the user would like to consume the beverage in the container.

The closure devices known in prior art routinely consist of a lid element, on which the chamber is arranged, and an inner housing. The closure device is as a rule screwed onto the container as a whole, i.e., completely preassembled. For this purpose, the inner housing has a thread that positively corresponds with the thread of the container. In addition, the lid element and inner housing are connected with each other by positively corresponding threads. When opening the container, i.e., when screwing off the lid element, the lid element—and thus the chamber arranged on the lid element—is moved relative to the inner housing. The lid element is here moved from a closed position into a discharge position, wherein a medium in the chamber can exit into the container in this discharge position. To this end, the chamber and inner housing have mutually corresponding closure means and opening means for closing and opening the discharge opening. For example, these corresponding closure and opening means can be designed like a single stop element arranged on the inner housing, wherein a first end region comprises the closure means and a second end region comprises the opening means. The stop element prevents or allows the medium to exit into the container, depending on its setting inside of the discharge opening of the chamber. However, the corresponding closure and opening means can alternatively also be separate elements, for example a membrane that closes the discharge opening of the chamber, and a mandrel arranged on the inner housing. When the lid element moves relative to the inner housing, the closure means is destroyed by the opening means, wherein the discharge opening of the chamber is released, and the medium can exit into the container.

For example, publication WO 2007/129116 A1 relates to a closure device according to prior art for attachment to a container. The closure device has a lid element that defines a chamber, along with an inner housing with a plug element, which can engage into a discharge opening in a lower wall of the chamber so as to form a seal. The lid element is provided with a thread that can engage into a corresponding thread of the inner housing, so that the lid element can be shifted relative to the inner housing out of a closed position, in which the plug element closes the discharge opening of the chamber, into a discharge position, in which the plug element is at least partially retracted from the discharge opening, in order to release a discharge channel arranged between the chamber and container.

Known from EP 0 520 207 A1 is a closure device for a container, in which the chamber is integral in design throughout. Known from CN 201785846 A is a closure device in which the chamber has a chamber lid, but a foot area of the chamber itself only interacts with the container in terms of fastening the chamber thereto.

SUMMARY OF THE INVENTION

Proceeding from the mentioned prior art, the invention initially deals with the object indicating a closure device that enables an advantageous chamber filling and connection with the container.

This object, is achieved by a closure device, in which the chamber has a first region above the first threaded means and a second region above and/or horizontally overlapping the first threaded means and/or below the first threaded means, wherein the first region is designed radially larger than the second region relative to the rotational thread axis and that the chamber have a horizontal division above the first threaded means relative to a use position in which a longitudinal device axis extends in a vertical, as a result of which the chamber is divided into a lower chamber part and an upper chamber part, and the lid element is designed to interact with a container neck by way of a thread.

The second region can be limited in terms of its radial extension by the restrictive dimensions of the container, in particular of the container opening. The second region can extend into a container neck in the allocation and use position. The first region extending vertically upward on this second region can be allocated to the container so as not to restrict the radial extension of the first region, so that a larger one by comparison to the second region can be selected as viewed transverse to a rotational axis of the thread.

As a result, the overall capacity of the chamber can be increased for the same container.

The first region can here have a radial dimension corresponding to that of an allocated container section, for example a container neck having the container opening. The radial dimension of the first region of the chamber can further correspond to 1.2 times or more up to 5 times, preferably roughly 2 times, the corresponding radial dimension of the second region. The division formed on the upper side of the first threaded means relative to a use position yields a multipart chamber.

This offers production-related advantages. In addition, a horizontal division above the first threaded means can yield an upper chamber part designed as a chamber lid, to be allocated to the lower chamber part preferably so as to form a seal after the chamber has been filled with the liquid to be stored. The connection between the upper chamber part and lower chamber part can be realized by a threaded screw connection, or also, by a clip or bounce connection. Also possible is a welded joint or (food-safe) adhesive bond.

The horizontal division preferably relates to a use position of the closure device or container, in which a longitudinal device axis or a longitudinal container axis extends in a vertical. The dividing plane can also extend transversely directed toward a container neck axis.

The chamber consisting of several parts can vertically continue over the first threaded means at the top relative to a use position of the container, wherein a first part has a vertically upward extension proceeding from a connecting region with the second part, and is situated at least partially above the first threaded means.

The object is further achieved by having the chamber extend laterally above the first threaded means until over the first threaded means, welding the chamber to the lid element, wherein the chamber has a connecting flange aligned essentially parallel to an adjacent surface of the lid element, and connecting the chamber with the lid element along the resultant annularly formed region.

As a result of the proposed solution, a radial chamber expansion above the first threaded means can be achieved, which as a whole leads to a favorable enlargement of the chamber volume given the same container opening or the same container neck diameter. The lateral or, in relation to a device axis, radial expansion of the chamber above the first threaded means can dimensionally orient itself to a lid element that interacts with the container neck, preferably by way of a thread. The radial expansion of the chamber above the first threaded means can further be oriented to the outer diameter of the container in the region of the container opening. Changing the dimensions of the chamber expansion viewed transversely and/or longitudinally to the device axis makes it possible to adjust the closure device to varying quantities of substances to be stored in the device.

The chamber can be only positively connected with the lid element. As a result of the positive connection, the chamber can be shifted as well via the lid element while turning the latter. The chamber can further be moved with the lid element linearly along a longitudinal device axis or a longitudinal container opening axis during the rotary actuation of the lid element and/or rotated around the longitudinal axis owing to a non-rotatable connection.

For purposes of a positive connection, the chamber can have projections or ribs that radially protrude relative to a longitudinal device direction, and interact with correspondingly positioned counter-positive-locking means of the lid element. Such counter-positive-locking means on the lid element can be over-molded or molded while manufacturing the lid element, or also over-molded while arranging the lid element on the closure device allocated to the container opening, for example through press rolling while forming the lid element out of aluminum.

Another proposed solution provides that the closure means in a sealing plane have a soft plastic radially outward and a rigid plastic radially inward.

Such a configuration makes it beneficial to fabricate the closure means in a 2-component manufacturing process.

As preferred, the outer soft plastic can incorporate sealing properties, thereby eliminating the potentially separate use of a gasket in the sealing plane.

The closure means can consist completely or even just partially radially outwardly of a soft plastic, possibly correspondingly partially interrupted by rigid plastic regions.

In addition, a proposed solution provides that a front surface of the closure means facing the tank interior consist entirely or partially of a soft plastic.

This provides a favorable opportunity to manufacture the closure means in a multi-cavity mold. This also makes it possible to use a material tailored to the liquid to be stored in the chamber, potentially with consideration of a sufficient (core) stability that can be provided by the radially inner (harder) material.

The second region can have an expansion region required for adjustment to the first region, which is preferably over-molded in a materially integral manner. In a preferred embodiment, the expansion region in a conventional use position of the container extends vertically above the container opening. The expansion region can also be stepped in relation to a vertical section.

The expansion region can also have a conical region in relation to a vertical section, in particular a conical region that tapers radially inward in the use position. This results in an improved residual emptying of the chamber, in particular of the first region of the chamber.

As is preferred, the two chamber parts can consist of plastics that can be welded to each other. The two chamber parts preferably consist of identical thermoplastic resins.

In a preferred embodiment, the expansion region of the chamber can have a radial extension corresponding to 0.8 to 1.2 times the diameter at the thread base of a second thread for interacting with the container. This makes the closure device easy to handle. The diameter of the lid element interacting with the second thread of the container is only negligibly enlarged relative to the threaded region in the area of the chamber expansions, if at all. In addition, the formation of the expansion region enlarges the angle of attack of the lid element wall extending essentially concentrically to the rotational axis of the thread through the chamber region extending vertically over the container opening, which can result in a diminished exertion of force when opening the closure device.

The chamber can be enveloped by an outer metallic sleeve. The latter is further preferably non-rotatably connected with the chamber parts. An aluminum sleeve can here be involved. The radial expansion region of the chamber is preferably gripped by the sleeve even after the chamber has been removed from the container. A radially retracted section of the sleeve vertically underneath the expansion region can be used for this purpose in a conventional use position. The latter can be molded onto the second thread on the container side during a conventional press rolling of the sleeve wall.

The overall contained volume of the chamber can comprise up to 40% or more, e.g., 60% or even 80% up to 95%, of the total volume above a plane resulting from sealants formed on the closure device, which are provided for establishing a seal on a front surface of a container.

As viewed on the chamber, the first threaded means can also face radially outwardly from the rotational axis of the thread. The movement of the chamber relative to the inner housing can be enabled by corresponding threads arranged on the chamber and inner housing. Having the first threaded means formed on the chamber face radially outward as viewed from the rotational axis of the thread makes it possible to arrange the chamber along with the thread inside of the container. The chamber and inner housing here remain engaged with each other even in the discharge position, so that the inner housing with the chamber arranged on the lid element can be removed from the container.

Because the first threaded means was shifted into the interior region of the container, the fit of the closure device on the container no longer depends on a precise dimensioning of the container in the region of the container opening. Rather, the tightness of the container closed with the closure device can be ensured even given dimensional deviations of the container, in particular of a glass bottle.

In order to compensate for any dimensional deviations, a preferably elastic seal can be especially easily arranged between the inner housing of the closure device and the inner wall of the container in the region of the container opening.

It can be provided that the side of the inner housing facing away from the first thread have a press seal for abutting against a container in the region of the container opening. This press seal can especially advantageously be welded to the inner housing. The elasticity of the press seal makes it possible to compensate for dimensional fluctuations while manufacturing the glass bottle, so that the closure device optimally seals the container opening.

It can further be provided that the lid element be an aluminum element press rolled onto the container to form a second thread, wherein the second thread formed on the lid element corresponds to a second thread of the container. The aluminum element serving as the lid element is here press rolled onto the outer wall of the container in the region of the container opening, so that a thread is embossed into the lid element. The lid element and container are thus positively corresponding elements, which ensure the tightness of the container closed with the closure device. It is here also advantageous that a technology can be utilized for manufacturing the lid element that is already in routine use for closing glass bottles with aluminum lids.

As an alternative or in addition to a positive connection between the chamber and lid element, it can be provided that the chamber be welded to the lid element. It is here also possible that the lid element simultaneously seals an opening formed in the chamber. As a consequence, the lid element can serve both as a closure element for the opening of the chamber and as a closure element for the container as such. Welding can here take place in different ways, for example via ultrasound, induction or even resistance heating.

It can further be provided that the chamber have an opening with an edge region beveled like a collar, wherein the lid element is welded to this edge region to seal the opening. The chamber thus advantageously has a kind of connecting flange, which is essentially aligned parallel to an adjacent surface of the lit element. In particular, the edge region beveled like a collar can here be a region of the chamber wall beveled by 90°. In an especially easy way, this yields a region aligned parallel to the surface of the lid element. The chamber can advantageously be connected with the lid element along this—preferably annular—region, i.e., along the opening. In the welding process, this region is advantageously used to weld the lid element with the chamber. In order to increase the adhesion between the aluminum lid element and chamber, it is also recommended that the lid element be coated with a paint in the region of the weld. The composition of the paint must be tailored to the respective chamber material.

It can further be provided that the beveled edge region of the chamber protrude in a radial direction of the closure element over an edge region of the inner housing situated adjacent thereto. This results in a "projection" or protruding "nose" on the lid element, around which the aluminum of the lid element is rolled, thereby additionally reinforcing the connection between the chamber and lid element. This ensures that the chamber will also be moved simultaneously when twisting the lid element from the container.

As an alternative to making the lid element out of aluminum as described above, the invention proposes that the lid element be a plastic element, which has a second thread corresponding to a second thread of the container. In this embodiment variant, the second thread of the lid element is not stamped with the container only in the connection process, but rather already while manufacturing the lid element itself, i.e., prior to final assembly with the container.

As also already explained with respect to the aluminum lid element, it is also recommended in conjunction with the plastic lid element that the side of the inner housing facing away from the chamber have a press seal for abutting against the container in the region of the container opening. In this respect, the necessary tightness of the container screwed to the closure device is ensured.

It can also be provided that the chamber have an opening with an edge region beveled like a collar, wherein the edge region has welded to it a film element for sealing the opening, wherein the film element is connected with the lid element. In this embodiment variant, the chamber is designed as a unilaterally open container, the opening of which faces in the direction of the lid element in the assembled state of the closure device. This opening can be used to easily fit the chamber with the closure means and opening means, for example, so that a completely preassembled "chamber unit" is created prior to connecting the chamber and lid element—as is also possible previously with respect to the aluminum lid, and subsequently only has to be connected with the lid element.

A film element between the chamber and lid element that additionally seals the chamber opening fluid tight can also ensure the necessary tightness of the closure device.

It can also be provided that the film element be welded to at least one partial region of the chamber and at least one partial region of the lid element. As an alternative to welding, the connection between the film element and lid element can be established using other technologies, for example adhesive bonding or the like. With respect to a welding process, it can be provided that either all three parts—the chamber, film element and lid element—be welded together at essentially the same welds, in particular also at the same time, or that the welds alternatively deviate locally. This is beneficial in particular if the melting points for the materials comprising the lid element and chamber are so different that there is a risk that one of the materials will be heated beyond its melting point. In this case, it is recommended that the welds be locally separated from each other. For example, the lid element and film element can be welded together in the region of the chamber opening, while the chamber and film element are welded together in the area of the edge region of the chamber that is beveled like a collar.

The material of the lid element is routinely PP (polypropylene). PP has a melting point of approx. 210° C. By contrast, the chamber material, PBT (polybutylene terephthalate), has a melting point of approx. 320° C. As a consequence, the temperature required for welding the chamber and film element is higher than the temperature required for welding the lid element and film element. The chamber and film element should thus advantageously be welded together independently of the lid element, so as not to impair the material of the lid element. The lid element and film element can then be welded together separately in terms of time and location. The location of the weld between the lid element and film element is then not confined to the area of the edge region beveled like a collar, but rather can in principle lie in the entire contact region between the lid element and film element, for example also in the region of the chamber opening.

The film element is preferably an aluminum film. Aluminum films are gas- and airtight, and also soft and flexible after heat treatment. Therefore, they are particularly suitable for packaging foods.

In order to increase the adhesion between the aluminum film and the chamber or the aluminum film and the lid element, it also makes sense for the aluminum film to be coated with a paint. The composition of the paint must be tailored to the material of the chamber or of the lid element.

The film element can alternatively also be a multilayer film having plastics, wherein the plastics are adjusted to the materials of the lid element and chamber. For example, in a case where the lid element is made out of PP and the chamber out of PBT, it makes sense to have a multilayer film, which has the successive layers PP, EVOH and PBT. EVOH (ethylene vinyl alcohol copolymer) is a copolymer routinely used for packaging foods. In particular, the latter provides a barrier to oxygen and carbon dioxide. A primer can additionally be provided between the layers comprised of PP and EVOH or EVOH and PBT, which further increase the adhesion between the adjacent layers.

If the chamber is not provided with an opening, the latter can alternatively also be over-molded with the material of the lid element for connection with the lid element.

It can additionally be provided that the chamber have a discharge opening that is provided with a closure means, and can be opened by means of an opening means arranged on the inner housing. As is already the case in prior art, these corresponding closure means and opening means can be a membrane and a mandrel that pierces the membrane or a cutting element; alternatively, however, the closure element and opening means can be designed as an integral plug element, which closes or releases a discharge channel depending on its position inside of the discharge opening.

Apart from the closure device for a container described above, the invention also proposes a container with an aforementioned closure device, wherein the container has a second thread in the region of the container opening that is connected with a second thread of a lid element of the closure device in a positively corresponding way.

In addition, the invention also proposes a method for discharging a medium from a closure device into a container, in particular from a closure device previously described, wherein the closure device has a lid element for closing a container opening, a chamber arranged on the lid element and an inner housing, wherein corresponding closure means and opening means allocated to the chamber and inner housing interact with each other as the lid element moves relative to the inner housing in such a way as to release a discharge opening allocated to the chamber, so that a medium stored in the chamber exits into the container, wherein the chamber and inner housing are moved toward each other by means of a corresponding first thread arranged on the chamber and inner housing as the lid element moves, wherein the chamber is moved by a first thread that faces radially outward as viewed from a rotational thread axis of the closure device.

As a consequence, the invention proposes a method in which the rotational movement between the lid element and inner housing that occurs in prior art takes place by means of a thread arranged on the chamber and inner housing. The method according to the invention is especially advantageous for closure devices on glass containers.

In terms of disclosure, the ranges or value ranges or multiple ranges indicated above and below also include all intermediate values, in particular in one tenth-increments of the respective dimension, i.e., potentially dimensionless as well. For example, the indication up to 40% or more also includes the disclosure up to 40.1% or more, the disclosure of 0.8 to 1.2 times also includes the disclosure of 0.8 to 1.19 times, 0.81 to 1.2 times, 0.81 to 1.19 times, etc. This disclosure can serve on the one hand to cap a range limit from below and/or above, but alternatively or additionally to disclose one or several singular values from a respectively indicated range.

BRIEF DESCRIPTION OF THE DRAWINGS

While the invention will be explained below based on the attached drawing, the latter only shows exemplary embodiments. Therefore, a part that is only explained relative to one of the exemplary embodiments and not replaced by a different part in another exemplary embodiment due to the special feature highlighted therein is also described as an at least possibly present part for this additional exemplary embodiment. The drawing shows.

DESCRIPTION OF THE EMBODIMENTS

Figure 1:
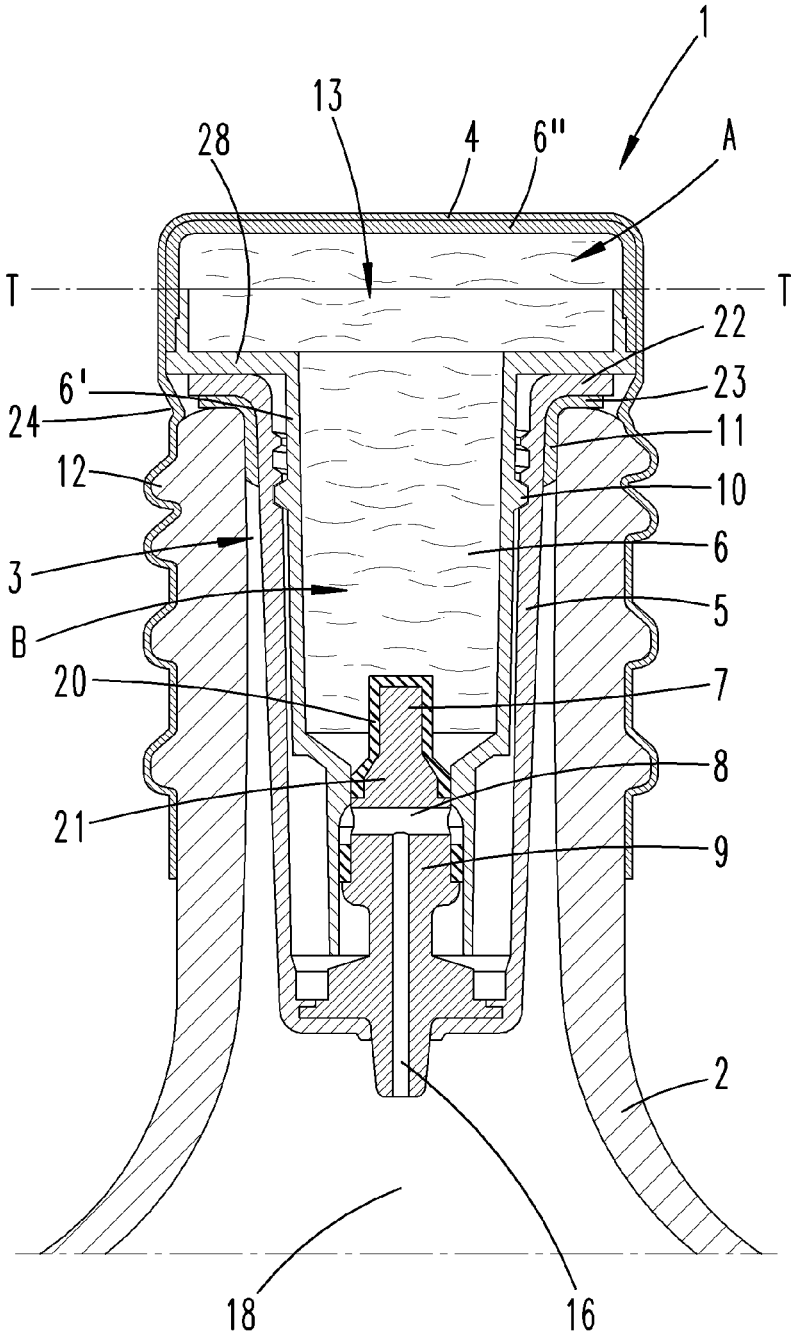
FIG. 1 a longitudinal section of a closure device with an aluminum lid element press rolled onto the container in a closed position.
Figure 2:
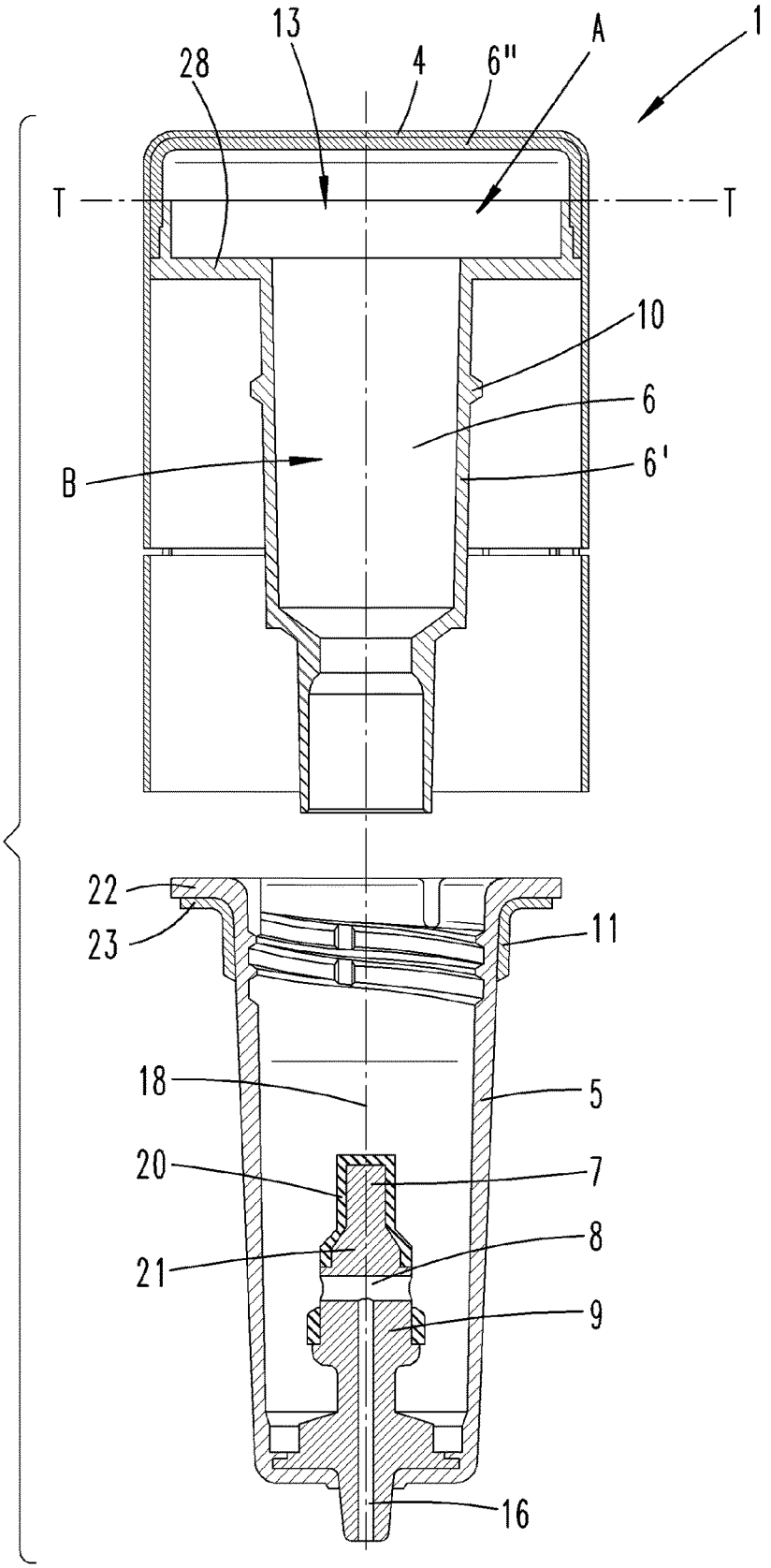
FIG. 2 a longitudinally cut exploded view of a chamber of the closure device with allocated lid element along with an inner housing with allocated closure means.
Figure 3:
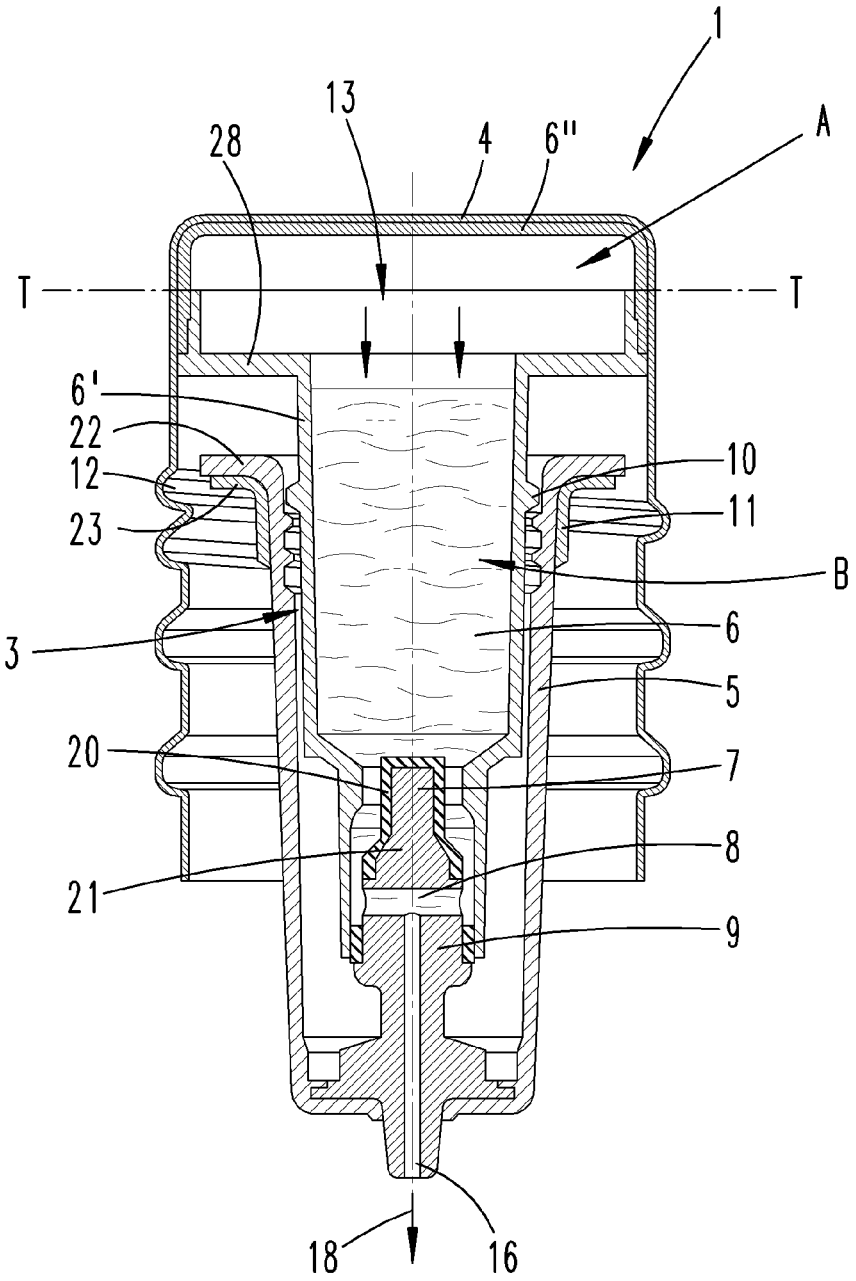
FIG. 3 a longitudinal section through the closure device during a rotational opening movement of the lid element.
Figure 4:
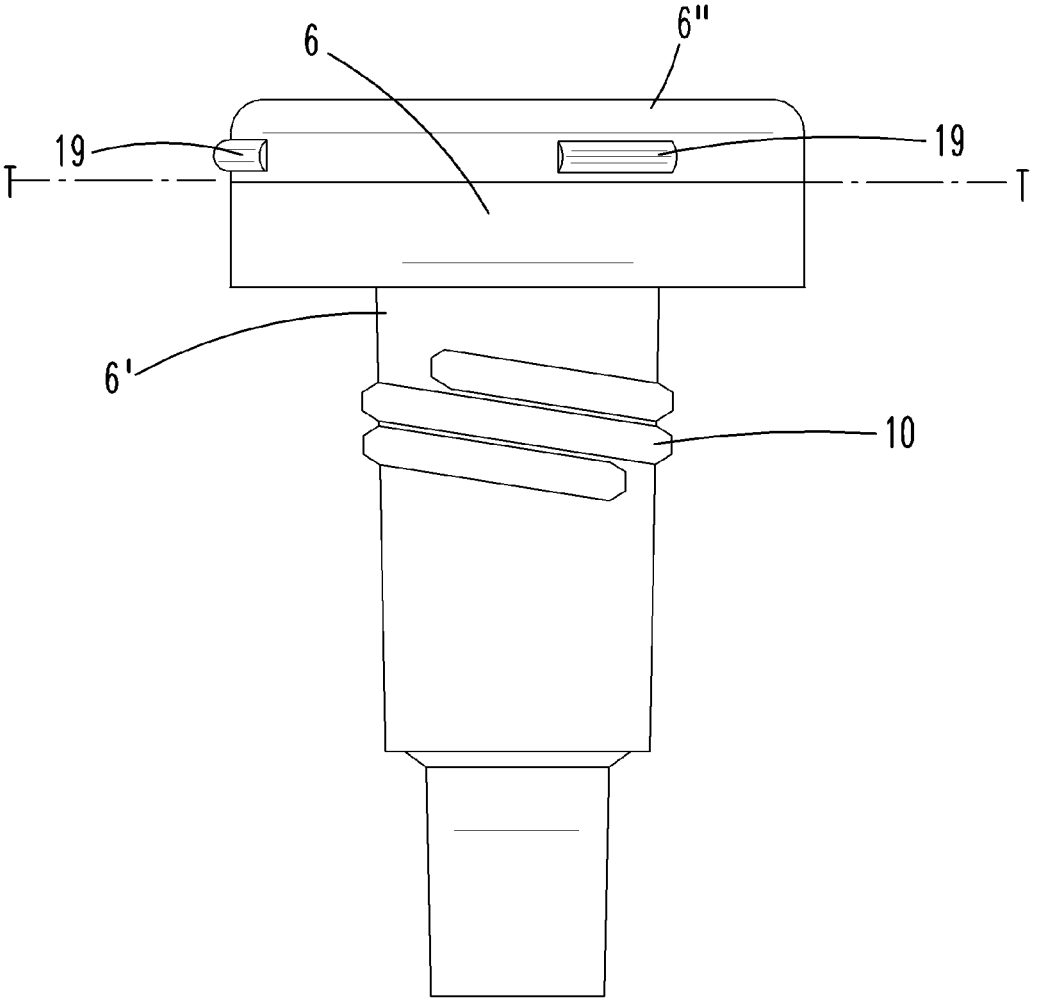
FIG. 4 a perspective detailed view of a chamber wall region with positive-locking ribs.

Shown and described initially with reference to FIG. 1 is a closure device 1 according to a first embodiment with an aluminum lid element 4 after press rolled onto a container 2.

The closure device is completely preassembled and screwed onto the container 2, so that a container opening 3 of the container is closed. In this state, the container 2 can be stored over a prolonged period without the contents being able to exit the container 2. Press rolling onto the container 2 forms a thread 4 on the lid element that corresponds to a second thread 12 of the container 2.

The closure device 1 has a lid element 4, a chamber 6 arranged on the lid element 4, along with an inner housing 5. In the embodiment variant shown, the lid element 4 is an aluminum lid.

The inner housing 5 forms a radially outwardly protruding flange 22, which supports the inner housing 5 against a front surface of the container 2 with a sealant 23 interspersed.

Chamber 6 and lid element 4 can only be positively connected. To this end, the chamber 6 or the part comprising the chamber 6 can have positive-locking ribs 19 that radially project on the outer wall side, and are spaced apart from each other as viewed over the circumference of the chamber wall. Press rolling the lid element material onto the outer chamber wall yields a non-rotatable positive entrainment in the region of the flashed positive-locking ribs 19, so that turning the lid element 4 correspondingly also causes the chamber 6 or part comprising the chamber 6 to rotate.

Turning the chamber 6 around the rotational thread axis 18 leads to a linear displacement of the chamber 6 along the rotational thread axis 18, resulting from first threaded means 10 formed on the chamber on the outer wall side engaging into a correspondingly positioned female thread of an inner housing 5.

The chamber 6 extends above the first threaded means 10, and in the use position further laterally above a container edge enveloping the container openings 3 until over the first threaded means 10. In this radially expanded first region A, the chamber 6 has a diameter adjusted approximately to the outer diameter of the container neck. The outer diameter of the first chamber region A can further roughly correspond to the diameter in the thread base of the second thread 12.

This radially expanded first region A extends in an axial direction over an axial dimension that corresponds to about one fourth to one third and up to half the axial length of the radially reduced second region B of the chamber 6, i.e., a region of the chamber allocated to the container neck. In relation to the threaded means 10, the radially smaller region B can be formed above and/or below these threaded means 10, as well as horizontally cover these first threaded means 10.

Figure 11:
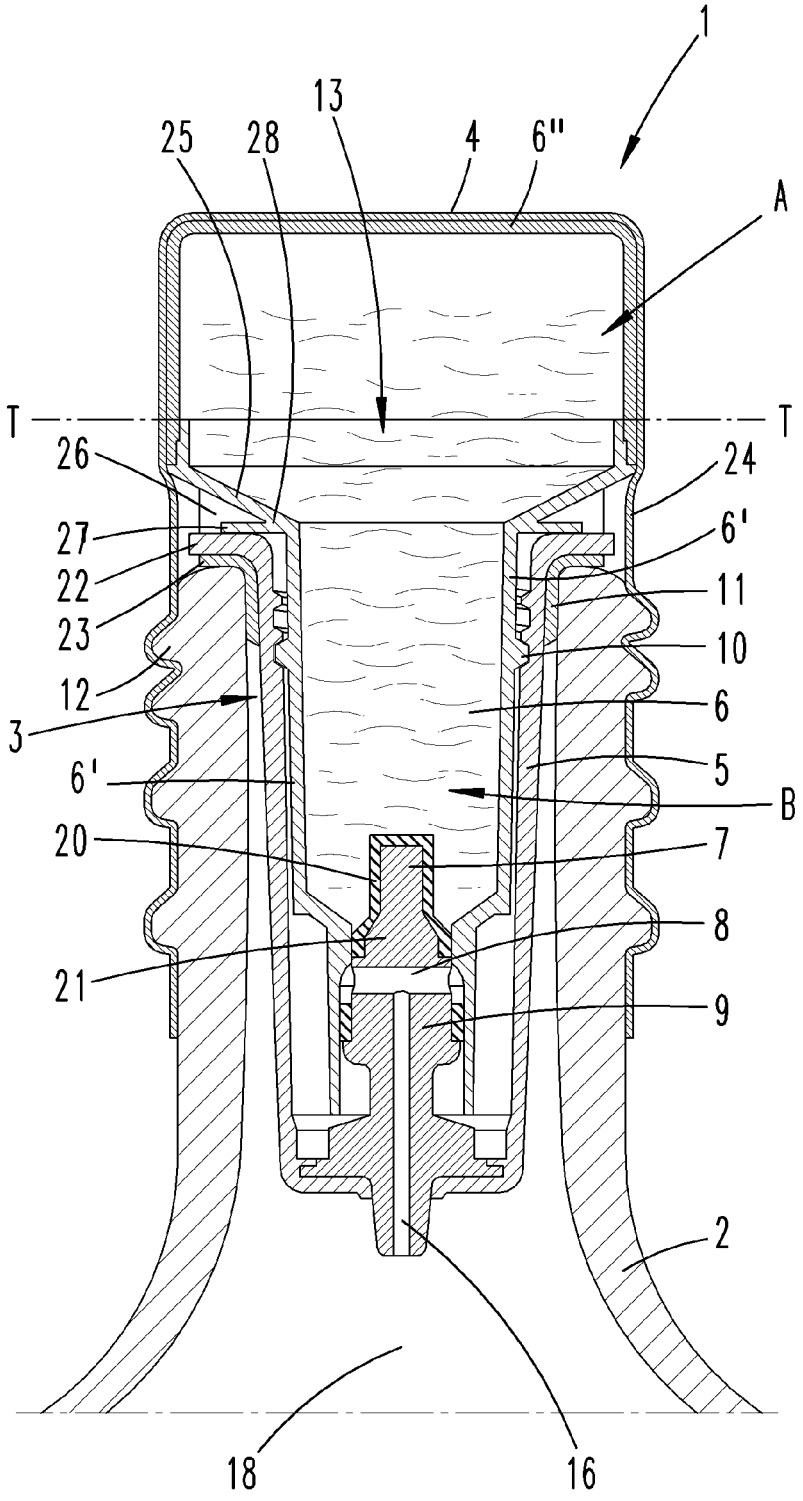
FIG. 11 an illustration corresponding to FIG. 1 and relating to an additional embodiment.
Figure 12:
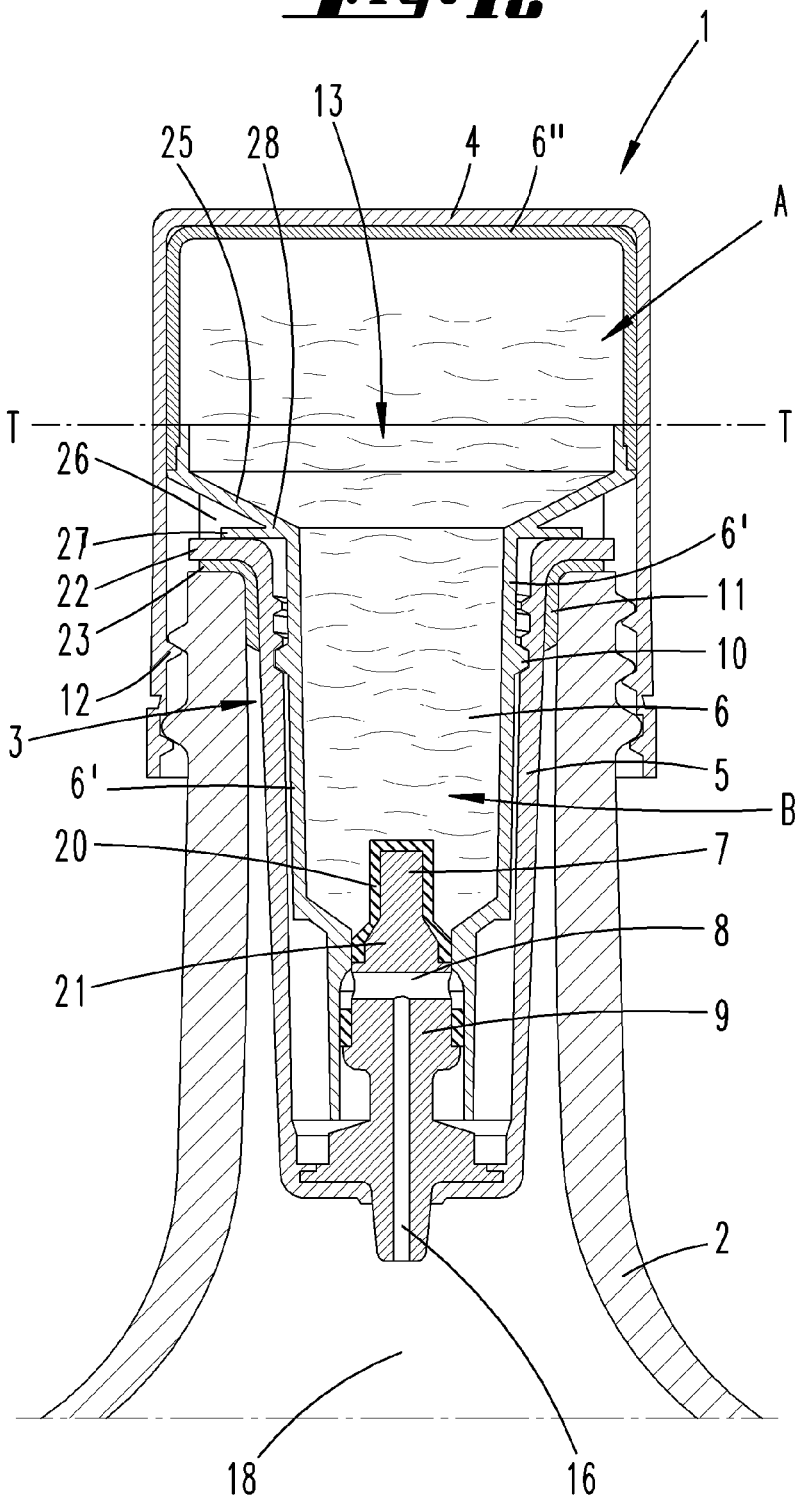
FIG. 12 a longitudinal section through an additional embodiment.
Figure 13:
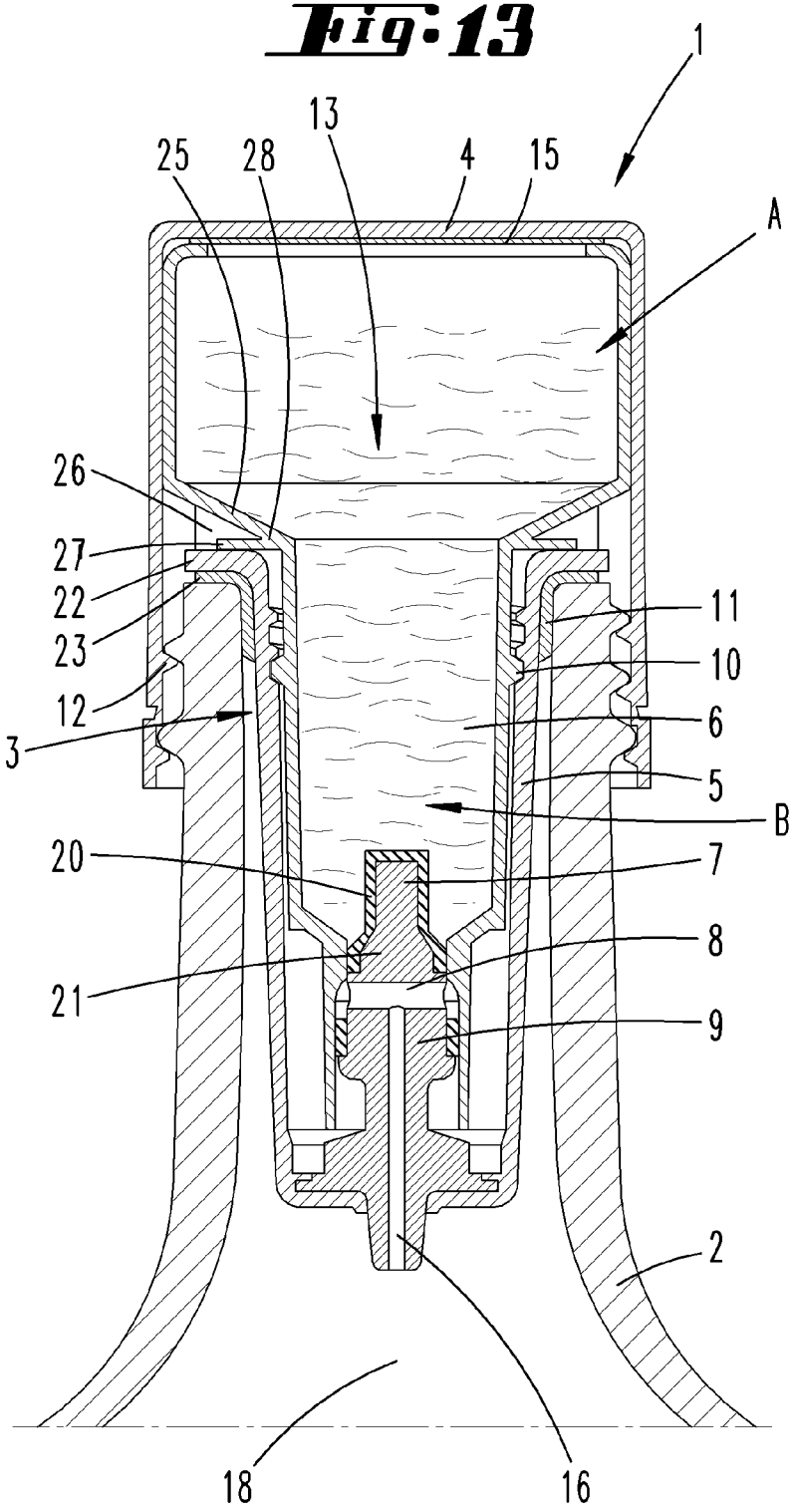
FIG. 13 an illustration corresponding to FIG. 12 and relating to an additional embodiment.

The expansion region 28 joining together regions A and B can be stepped or, for example as shown on FIGS. 11 to 13, taper vertically downward and radially inward.

This results in an increased volume of the chamber 6 given the same inner diameter of the container neck.

In particular press rolling the lid element-type sleeve wall onto the container neck yields a wall constriction 24 underneath the chamber expansion region that engages under the expansion region at the edge.

Relative to a use position according to FIG. 1, the chamber 6 further has a horizontal division T above the first threaded means 10 in the allocation position, and further preferably above the free front surface of the container opening 3, i.e., preferably in the radially expanded chamber region A.

The chamber 6 is divided into a lower chamber part 6' and an upper chamber part 6", wherein the upper chamber part 6" can be placed onto the lower chamber part 6' like a lid, in particular after the chamber 6 has been filled with the liquid. A latched connection can here be present. In this regard, a weld or adhesive bond can also be provided.

The positive-locking ribs 19 can be over-molded on the upper cap [sic] part 6" on the exterior wall.

A closure means 17 designed to interact with the food-side chamber outlet region can be manufactured in a 2-component spray process, in particular with a radially inner rigid plastic 21 and a radially outer soft plastic 20.

The closure means 7 can be completely enveloped by soft plastic 20 on the exterior wall, so that even a front surface of the closure means facing the tank interior consists of a soft plastic 20.

As is preferred, the soft plastic 20 can have sealing properties, in particular when the closure means 7 interacts with wall sections of the chamber 6 at the opening.

Reference is also made to the following statements with respect to the further configuration and function of the closure device 1 of the first embodiment (FIGS. 1 to 4).

Figure 5:
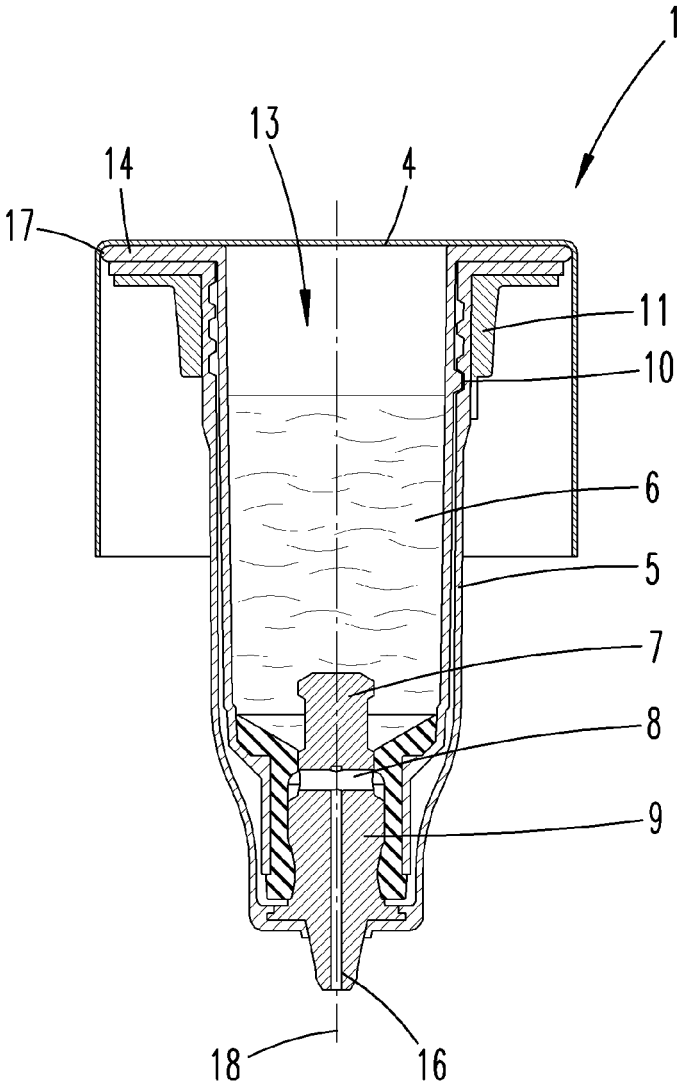
FIG. 5 a closure device with an aluminum lid element prior to press rolling onto a container.

FIG. 5 shows a closure device 1 according to another embodiment variant with an aluminum lid element 4 before press rolling onto a container 2. The lid element 4 still has no thread relative to an outer wall to be applied to a container 2.

Figure 6:
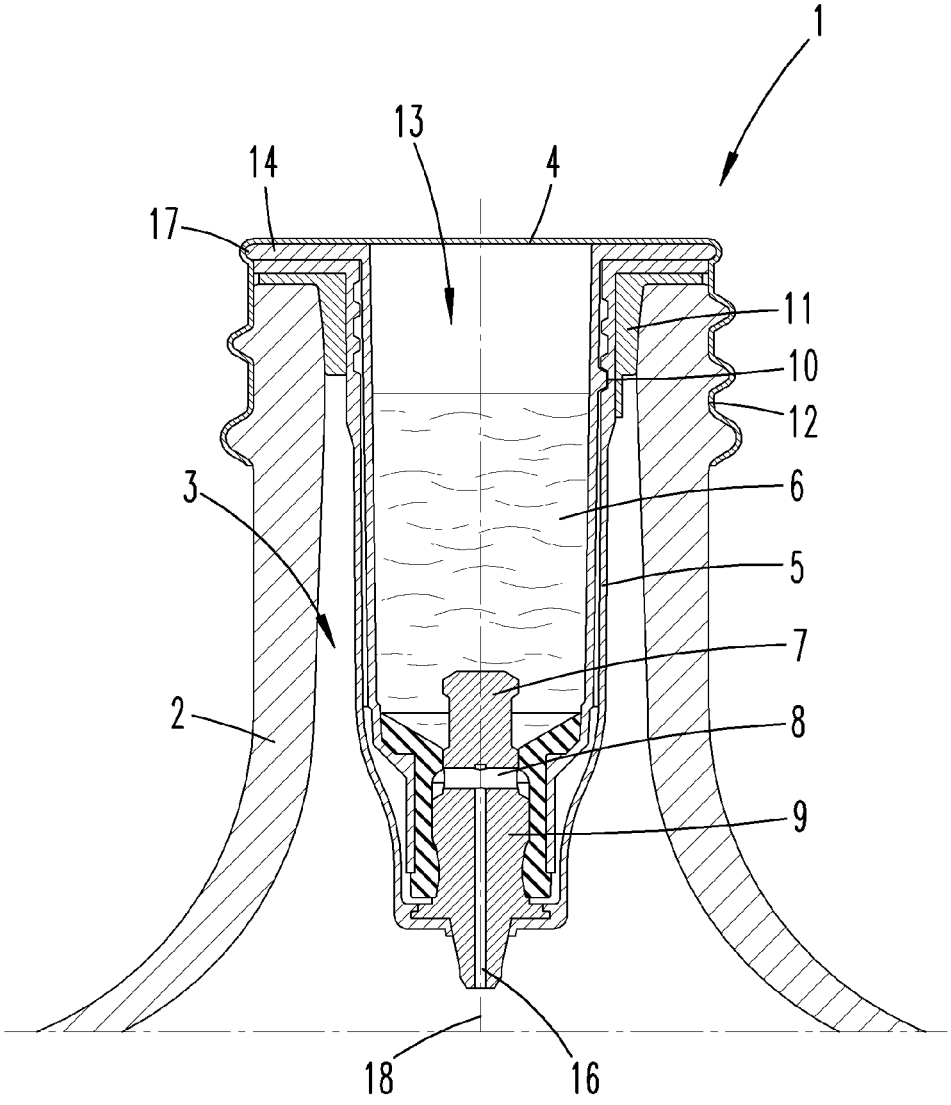
FIG. 6 a closure device with an aluminum lid element press rolled onto the container in a closed position.

FIG. 6 shows the closure device 1 according to FIG. 5 after press rolling onto a container 2. The closure device 1 is completely preassembled and screwed onto a container 2.

The closure device 1 has a lid element 4, a chamber 6 arranged on the lid element 4, along with an inner housing. In the embodiment variant shown, the lid element 4 is an aluminum lid. The lid element 4 is welded to the chamber 6. For example, the chamber 6 can consist of a plastic such as PBT (polybutylene terephthalate). In order to be able to weld the chamber 6 with the lid element 4 comprised of aluminum, an aluminum with a paint for PBT is recommended for the lid element 4. In its region directed toward the lid element 4, the chamber 6 has an opening 13, which can be used before covered with the lid element 4 to install additional elements of the closure device 1. For example, these elements can be closure means 7 and opening means 9 for closing and opening a discharge opening 8 arranged in the chamber 6. The discharge opening 8 is advantageously directed away from the lid element 4 ("downward" in reference to the closure device 1 shown on FIG. 6).

In the region of the opening 13, the chamber 6 has an edge region 14 beveled like a collar. The lid element 4 can be welded to this edge region 14.

The chamber 6 is connected with the inner housing 5 by means of corresponding first threaded means 10. Viewed from a rotational thread axis 18 of the closure device, the first threaded means 10 is arranged on the chamber 6 facing radially outward. This means that the first threaded means 10 is designed radially outside of the chamber 6 and inside of the inner housing 5 in relation to a vertical projection toward the rotational thread axis 18. The inner housing 5 is pressed by means of a press seal 11 into the container 2 in the region of the container opening 13. The lid element 4 and container 2 further have corresponding second threads 12, which connect the lid element 4 with the container 2.

In a cross section transverse to the rotational thread axis 18, the chamber 6 further has the edge region 14 extending radially outward like a flange, wherein the first threaded means 10 is designed radially inward relative to an outer edge of the edge region 14.

For example, the aforementioned closure device 1 as well as its arrangement on the container 2 is manufactured in such a way as to first fit the chamber 6 with the closure means 7 or opening means 9 that close or open the discharge opening 8 of the chamber 6. In the example shown here, the closure means 7 and opening means 9 are designed like an integrally configured plug element, which is introduced into the discharge opening 8 of the chamber 6. The partial region facing toward the lid element 4, i.e., the closure means 7, is formed in such a way depending on the position inside of the discharge opening 8 as to either close this discharge opening 8 or release a discharge channel 16, through which the medium located in the chamber 6 can flow out into the container 2. The opening means 9 facing away from the lid element 4 has a discharge channel 16 through which the medium can flow into the container 2. The opening means 9 is connected with the inner housing 5. In the example shown here, an edge region formed on the opening means 9 is over-molded by the material of the inner housing 5. Alternatively, however, a press fit could also be involved here.

After the chamber 6 has been completely prepared, it is connected with the lid element 4, which simultaneously closes the opening 13 of the chamber 6. The beveled edge region 14 of the chamber 6 is here welded to the lid element 4. In this state, the lid element 4 still represents a kind of blank, which still has no second thread 12 for connection with the container 2. In a subsequent step, the inner housing 5 is let into the container 2 via the container opening 3. In the process, the inner housing 5 along with a press seal 11 arranged on the inner housing 5 are pressed into the container opening 3. Finally, the chamber 6 with the lid element 4 arranged thereon is introduced into the inner housing 5, wherein the chamber 6 and inner housing 5 are screwed to each other by means of the corresponding first threaded means 10. During this screwing process, the lid element 4 is simultaneously rolled onto the second thread 12 of the container 2, wherein a second thread 12 forms in the lid element 4 as well.

As an alternative to the production method described above, the chamber 6 and lid element 4 can also be welded only once the lid element 4 has been screwed to the container 2.

In addition, it may be advantageous for connecting the chamber 6 and lid element 4 that the beveled edge region 14 be designed in terms of its radial dimension in such a way as to protrude over the surface of the container 2, thereby resulting in a projection 17 in the region of the container opening 3.

While press rolling the lid element 4 onto the container 2, the material of the lid element 4 drapes over this projection 17, thereby additionally strengthening the connection.

Figure 7:
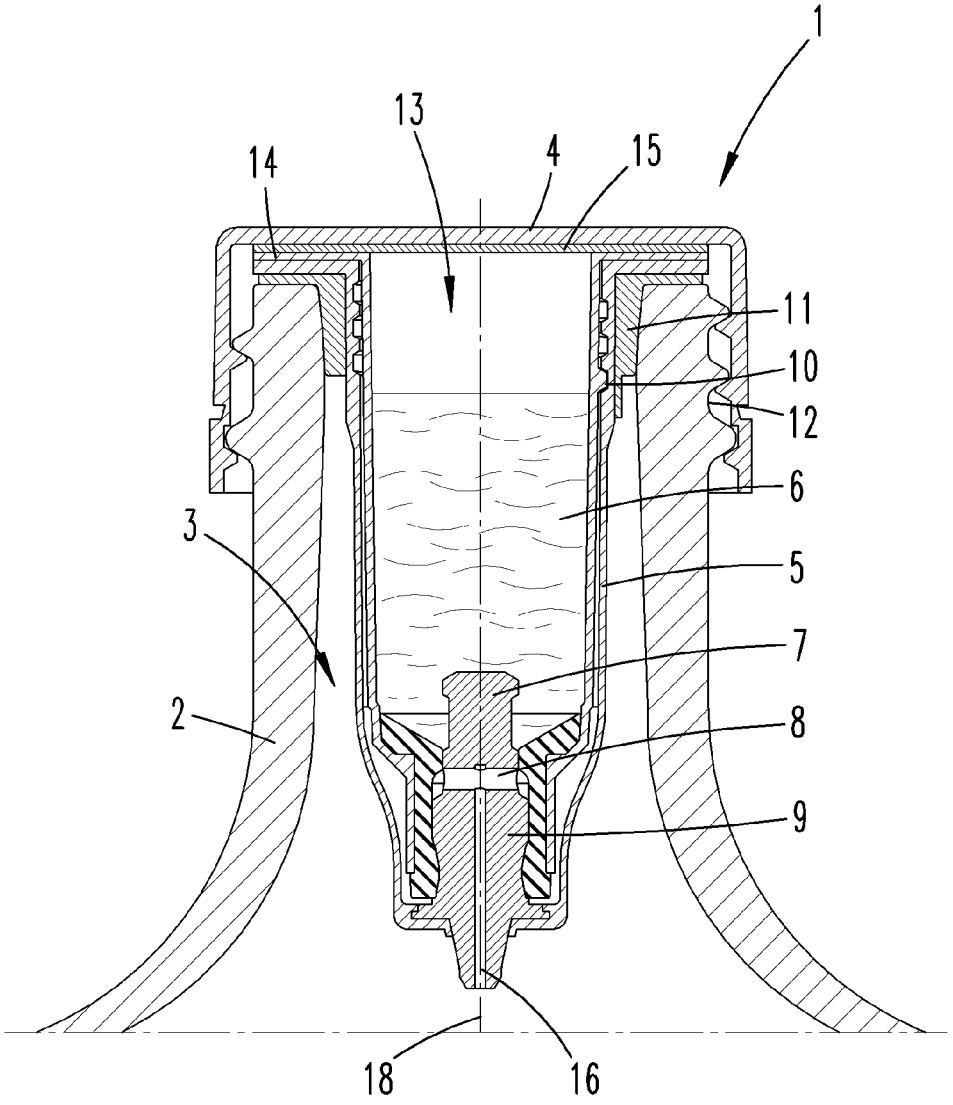
FIG. 7 a closure device with a plastic lid element in a closed position.

FIG. 7 shows an alternative embodiment of a closure device 1 according to the invention. The lid element 4 of this closure device 1 preferably consists of a plastic, for example PP (polypropylene) or PE (polyethylene). The basic structure of the closure device 1 is similar to the one depicted on FIG. 5. However, since the lid element 4 does not consist of aluminum, but rather of a plastic, the lid element 4 cannot be press rolled onto the container 2.

According to FIG. 7, the chamber 6 is closed in the area of its opening 13 with a film element 15. This film element 15 is advantageously an aluminum film, but can also consist of a plastic material, for example EVOH (ethylene vinyl alcohol copolymer), PET (polyethylene terephthalate) or the like. In the event that the film element 15 consists of aluminum, the side of the latter facing toward the chamber 6 is preferably coated with a paint for the material of the chamber 6, in particular PBT. The opposite side of the film element 15 facing toward the lid element 4 is advantageously coated with a paint suitable for connection with the lid element 4. For example, if the lid element 4 consists of PP, a paint for PP is recommended. In a subsequent procedural step, the film element 15 is welded to the chamber 6 or lid element 4. Welding can take place either in a combined procedural step or in sequential steps, for example wherein the film element 15 is first welded to the chamber 6, and only in an ensuing step to the lid element 4.

Otherwise, the closure device 1 according to FIG. 7 already has a second thread 12 formed on the lid element 4 for connection with the container 2.

The closure devices 1 according to FIGS. 6 and 7 are shown in a closed position. The container 2 is here connected fluid tight with the closure device 1, i.e., the closure means 7 is located inside of the discharge opening 8 of the chamber 6 in such a way that the medium stored in the chamber 6 cannot flow out through the discharge channel 16, but rather is enclosed in the chamber.

In order to now pour the medium stored in the chamber 6 into the container 2, it is required that the closure device 1 be moved into a discharge position. The steps to be taken for this purpose will be explained in greater detail below.

Figure 8:
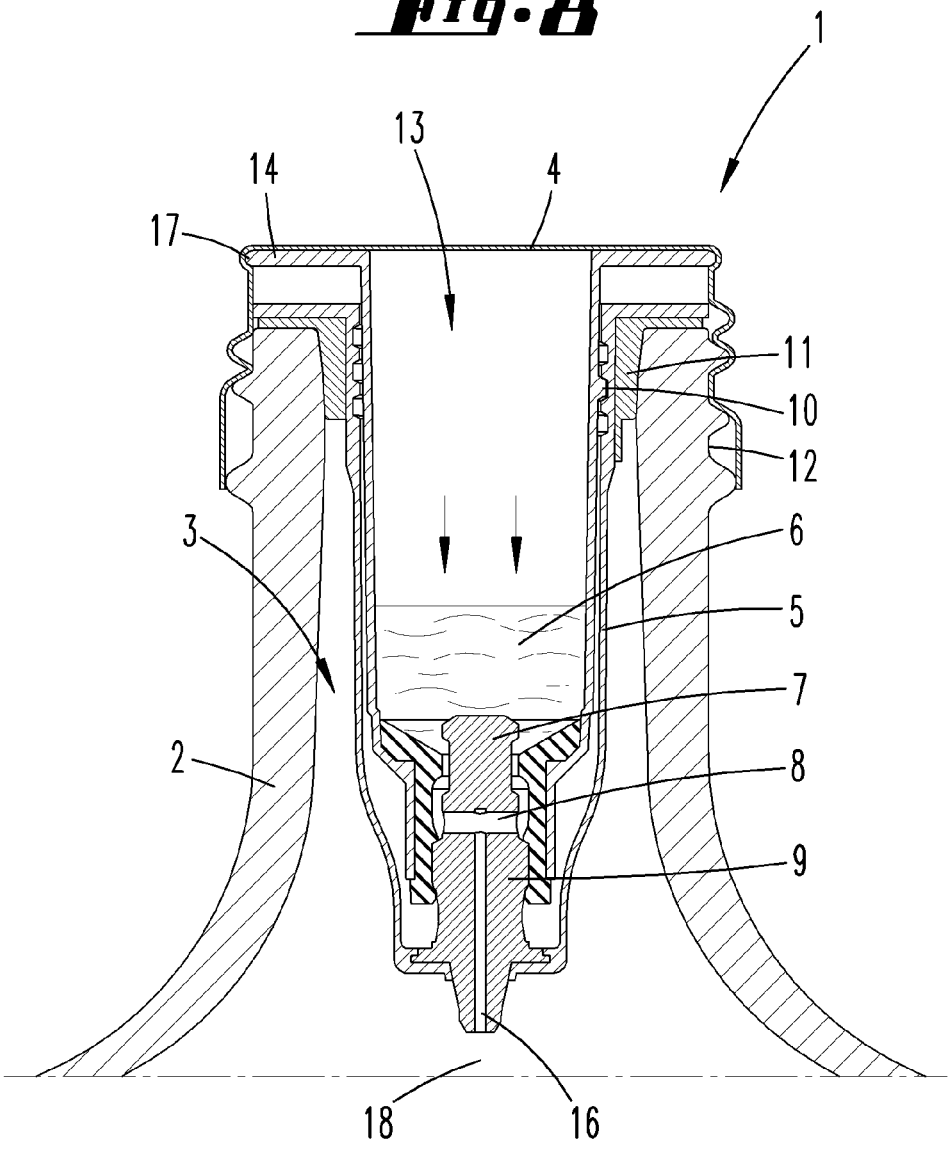
FIG. 8 the closure device according to FIG. 6 in a discharge position.

For example, FIG. 8 shows the closure device 1 according to FIG. 6 in a discharge position. Even though the discharge position is here depicted in relation to FIG. 6, the latter can also be designed just like the closure device 1 according to FIG. 7. The closure device 1 according to FIG. 8 thus serves only as an exemplary embodiment for the discharge position, and is in no way whatsoever limiting.

As shown on FIG. 8, the lid element 4 and container 2 must be removed from each other to realize a discharge position. This longitudinal shifting of the lid element 4 and container 2 simultaneously also shifts the chamber 6 arranged on the lid element 4 and the inner housing 5 arranged on the container 2 toward each other. Since the closure means 7 or opening means 9 are arranged on the inner housing 5, shifting the chamber 6 relative to the inner housing 5 is simultaneously also accompanied by a shifting of the closure means 7 or opening means 9 inside of the discharge opening 8 of the chamber 6. This releases the discharge opening 8, so that the medium stored inside of the chamber 6 can flow through the discharge opening 8 and the discharge channel 16 formed inside of the opening means 9 into the container 2.

In order to generate a longitudinal movement between the lid element 4 and container 2, the corresponding second threads 12 formed on the lid element 4 and container 2 are rotated toward each other. This rotation simultaneously causes the chamber 6 to rotate inside of the inner housing 5. This rotation is enabled by the first threaded means 10 formed on the chamber 6 and inner housing 5. Because the inner housing 5 is fixedly pressed into the container 2 by the press seal 11, the inner housing 5 remains fixedly connected with the container 2 while unscrewing the lid element 4 from the container 2 or rotating the chamber 6 inside of the inner housing 5. Only once the first threaded means 10 of the chamber 6 has reached an end region of the first thread 10 of the inner housing 5 is the corresponding first threaded means 10 locked in place, as a result of which, as the lid element 4 continues to be unscrewed from the container 2 accompanied by the detachment of the chamber 6 secured to the lid element 4 from the container 2, the inner housing 5 simultaneously also detaches from the container 2. The press seal 11 arranged on the inner housing 5 is here also detached from the container 2. The contact pressure of the press seal 11 inside of the container 2 is overcome.

During the unscrewing process, the chamber 6 is first moved relative to the inner housing 5, so that the chamber 6 simultaneously moves by the closing means 7 or opening means 9 connected with the inner housing 5. A partial region of the discharge opening 8 is here opened between the closure means 7 and inner housing 5, so that the medium stored in the chamber 6 can flow through the discharge channel 16 of the opening means 9 into the container 2.

Figure 9:
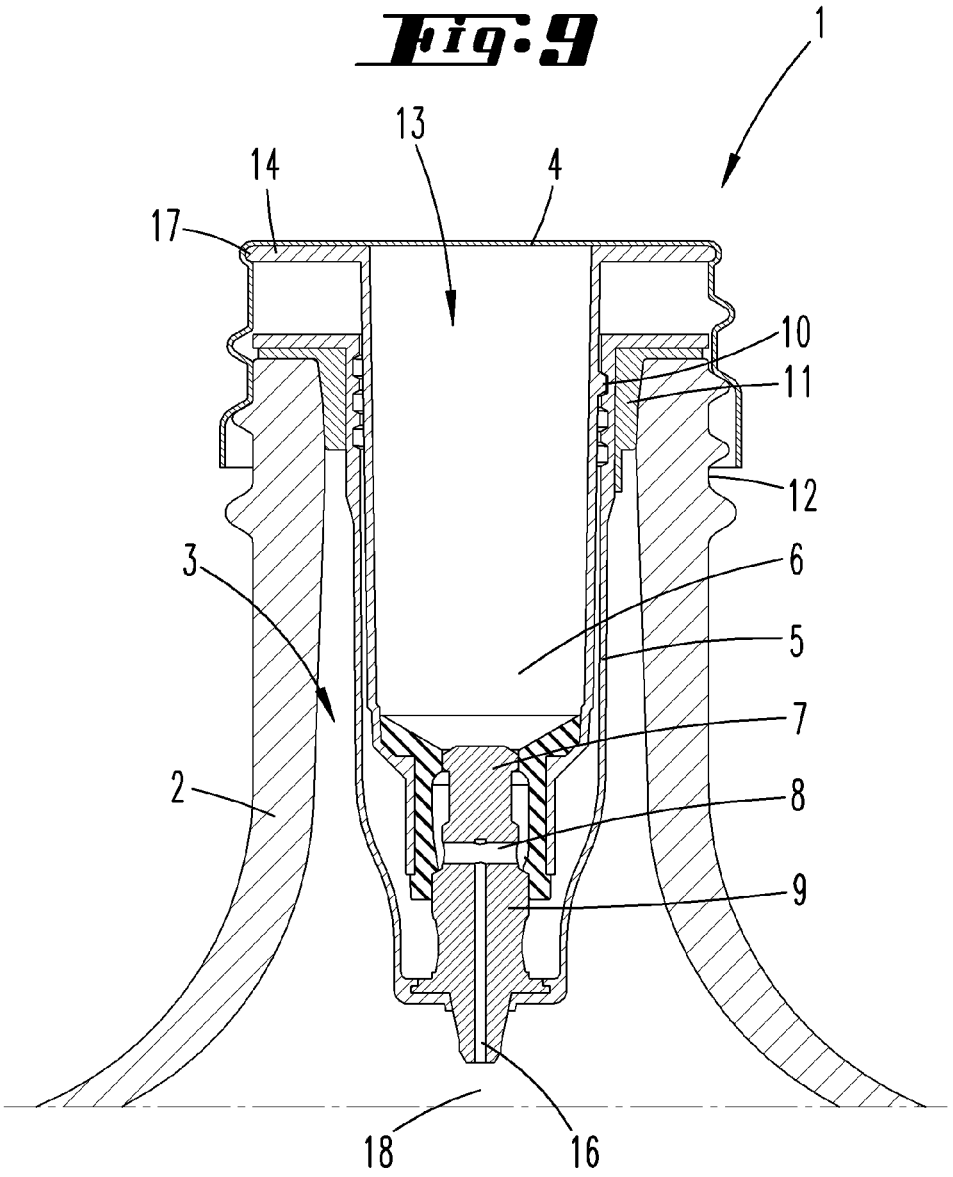
FIG. 9 the closure device according to FIG. 6 while unscrewing a container.

FIG. 9 shows an ensuing position: As the chamber 6 continues to be lifted, the upper end region of the closure means 7 can get into a position relative to the discharge opening 8 in which the discharge opening 8 is again closed, thereby preventing medium from dripping out of the chamber 6. To this end, the upper end region of the closure means 7 is routinely radially expanded relative to the adjacent regions of the closure means 7. This position is optional. Finally, the second threads 12 of the lid element 4 and container 2 detach from each other, while the first threaded means 10 of the chamber 6 and inner housing 5 are in an end position. The chamber 6 and inner housing 5 cannot twist any further toward each other in this end position.

Figure 10:
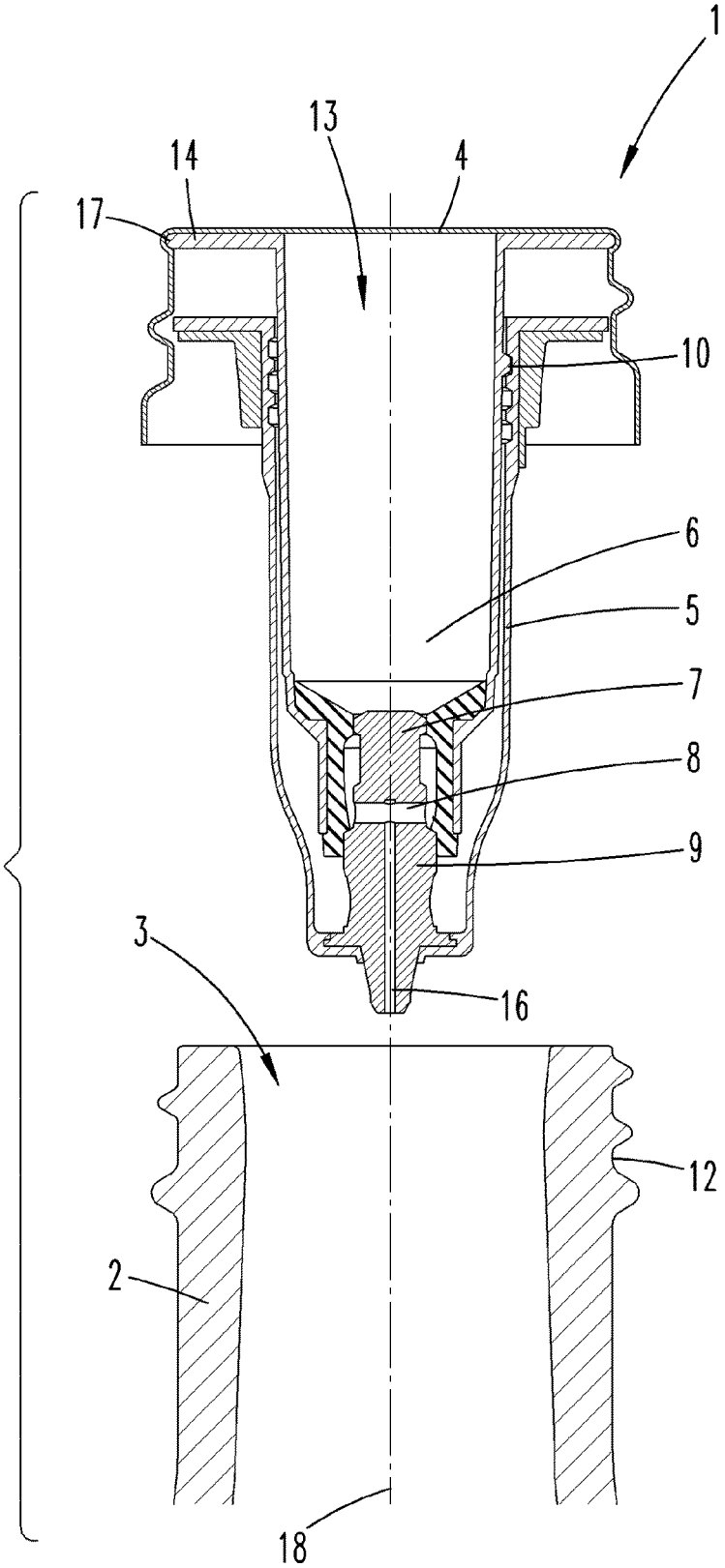
FIG. 10 the closure device according to FIG. 6 separated completely from the container.

FIG. 10 shows the closure device 1 completely removed from the container 2. The closure means 7 secures the discharge opening 8 of the chamber 6 against any dripping of medium from the chamber 6.

FIG. 11 shows an embodiment that builds on the design depicted on FIG. 1, wherein the latter is enlarged by comparison to the volume of the expansion region (first chamber region A). This is achieved by selecting an enlargement in a vertical direction relative to the version on FIG. 1, i.e., along the rotational thread axis 18, in particular of the wall of the upper chamber part 6".

If the exemplary embodiment according to FIG. 1 yields a volumetric percentage of about 60% in the first region A in comparison to the overall volume, the embodiment according to FIG. 11 results in a partial volume in the first region A of about 80%, with the outer diameter in the expansion region preferably remaining the same.

Also in relation to the depicted valve closure position, the second region B also transitions into a conical region 25 (expansion region 28) at roughly the height of the flange 22 on the inner housing. Proceeding from the second region B, the conical region 25 expands radially outward, and in the conventional use state, vertically upward. The upper chamber part 6" is fixed in place in the region of the circumferential free edge of the conical region 25.

One or several struts 26 support the conical region 25 either directly on the flange 22 that also overlaps the front surface of the container 2 and/or on a flange section 27 of the chamber 6 or lower chamber part 6', which in the basic position according to FIG. 11 rests on the flange 22.

FIG. 12 shows another alternative embodiment of a closure device 1 according to the invention. The lid element 4 of this closure device 1 preferably consists of a plastic, for example polypropylene or polyethylene. The basic structure of the closure device 1 is similar to the one depicted on FIG. 11. However, since the lid element 4 does not consist of aluminum, but rather of a plastic, the lid element 4 cannot be press rolled onto the container 2. Rather, a thread counter-designed to the second thread 12 is directly provided on the lid element 4.

The non-rotatable connection between the lid element 4 and chamber wall, in particular the upper chamber part 6", can be achieved through adhesive bonding or welding.

As illustrated on FIG. 13, the wall of chamber region B can also transition into the wall of chamber region A in a materially integral manner as a single piece, wherein a chamber lid of region A is closed by a film element 15, e.g., aluminum film. Preferably involved here is a film element 15 of the kind described for FIG. 7.

The above statements serve to explain the inventions encompassed by the application as a whole, which each also independently further develop prior art, at least through the following feature combinations, specifically:

A closure device, characterized in that the chamber 6 has a first region A above the first threaded means 10 and a second region B above and/or horizontally overlapping the first threaded means 10, wherein the first region A has a radially larger configuration than the second region relative to the rotational thread axis 18.

A closure device, characterized in that the chamber 6 has a horizontal division T above the first threaded means 10 relative to a use position.

A closure device, characterized in that the chamber 6 extends laterally above the first threaded means 10 until over the first threaded means 10.

A closure device, characterized in that the chamber 6 is only positively connected with the lid element 4.

A closure device, characterized in that the closure means 7 in a sealing plane has a soft plastic 20 radially outward and a rigid plastic 21 radially inward.

A closure device, characterized in that a front surface of the closure means 7 facing the tank interior consist entirely or partially of a soft plastic.

A closure device, characterized in that the second region B has an expansion region 28 molded on in a materially integral manner that is necessary for adjustment to the first region A, and/or that the expansion region 28 preferably has a conical region 25 in a vertical section, and/or that the expansion region 28 of the chamber preferably has a radial extension corresponding to 0.8 to 1.2 times the diameter at the thread base of a second thread 12 for interacting with the container 2.

A closure device, characterized in that both chamber parts 6', 6" consist of plastics that can be welded to each other.

A closure device, characterized in that the chamber 6 is enveloped by an outer metallic sleeve, and that the radial expansion region is gripped by the sleeve even after the chamber 6 has been removed from the container 2.

A closure device, characterized in that the contained volume of the chamber 6 can comprise up to 40% or more above a plane resulting from sealants 23 formed on the closure device 1, which are provided for establishing a seal on a front surface of a container 2.

All disclosed features are essential to the invention (whether taken separately or in combination with each other). The disclosure of the application hereby also completely incorporates the disclosure content of the accompanying/attached priority documents (copy of pre-application), even for the purpose of also including features in the claims of the present application. The features in the subclaims characterize independent inventive further developments of prior art, in particular for initiating partial applications based upon these claims.

REFERENCE LIST

| | | | |
|---|---|---|---|
| 1 | Closure device | | |
| 2 | Container | A | First region |
| 3 | Container opening | B | Second region |
| 4 | Lid element | T | Division |
| 5 | Inner housing | | |
| 6 | Chamber | | |
| 6' | Lower chamber part | | |
| 6" | Upper chamber part | | |
| 7 | Closure means | | |
| 8 | Discharge opening | | |
| 9 | Opening means | | |
| 10 | First threaded means | | |
| 11 | Press seal | | |
| 12 | Second thread | | |
| 13 | Opening | | |
| 14 | Edge region | | |
| 15 | Film element | | |
| 16 | Discharge channel | | |
| 17 | Projection | | |
| 18 | Rotational thread axis | | |
| 19 | Positive-locking rib | | |

-continued

| | |
|---|---|
| 20 | Soft plastic |
| 21 | Rigid plastic |
| 22 | Flange |
| 23 | Sealing means |
| 24 | Wall constriction |
| 25 | Conical region |
| 26 | Strut |
| 27 | Flange section |
| 28 | Expansion region |

The invention claimed is:

1. A closure device (1) for a container (2) with a container opening (3), wherein the closure device (1) has a lid element (4) for closing the container opening (3), an inner housing, and a chamber (6) arranged between the lid element (4) and the inner housing (5), wherein the chamber (6) and inner housing (5) have mutually corresponding closure means (7) and opening means (9), which interact with each other in such a way that a discharge opening (8) allocated to the chamber (6) can be released by moving the lid element (4) relative to the inner housing (5), so that a medium stored in the chamber (6) can exit into the into container (2), and the chamber (6) and inner housing (5) each have corresponding first threads (10) formed relative to a rotational thread axis (19), wherein the chamber (6) has a first region (A) above the first threaded means (10) and a second region (B) above and/or horizontally overlapping the first thread means (10) and/or below the first threaded means (10), wherein the first region (A) is designed radially larger than the second region (B) relative to the rotational thread axis (18), wherein a wall of the second region (B) is integral and in one piece with a wall of the first region (A) and has an opening (13) in an area facing the lid, wherein a closure of the chamber (6) is formed by a film element (15) bridging the opening (13) and having a lower side that is in contact with the chamber and that seals the chamber (6) fluid tight, and wherein the chamber (6) has a horizontal division (T) above the first threaded means (10) relative to a use position in which a longitudinal device axis extends vertically, as a result of which the chamber (6) is divided into a lower chamber part (6') and an upper chamber part (6"), and the lid element (4) is designed as a one piece element to interact with a container neck by way of a thread.

2. The closure device according to claim 1, wherein the chamber (6) is a separate element from the lid element and is only positively connected with the lid element (4).

3. The closure device according to claim 1, wherein the second region (B) has an expansion region (28) required for adjustment to the first region (A), which is over-molded in a materially integral manner.

4. The closure device according to claim 3, wherein the expansion region (28) has a conical region (25) in a vertical section.

5. The closure device according to claim 3, wherein the expansion region (28) of the chamber (6) has a radial extension corresponding to 0.8 to 1.2 times the diameter at a thread base of a second thread (12) for interacting with the container (2).

6. The closure device according to claim 1, wherein the two chamber parts (6', 6") consist of plastics that can be welded to each other.

7. The closure device according to claim 1, wherein the chamber (6) is enveloped by an outer metallic sleeve, and wherein a radial expansion region is also gripped by the sleeve even after the chamber (6) has been removed from a container (2).

8. The closure device according to claim 1, wherein the overall contained volume of the chamber (6) comprises up to 40% or more above a plane resulting from sealants (23) formed on the closure device (1), which are provided for establishing a seal on a front surface of a container (2).

9. A closure device (1) for a container (2), in particular a glass container, with a container opening (3), wherein the closure device (1) has a lid element (4) for closing the container opening (3), an inner housing, a chamber (6) arranged between the lid element (4) and the inner housing (5), wherein the chamber (6) and inner housing (5) have mutually corresponding closure means (7) and opening means (9), which interact with each other in such a way that a discharge opening (8) allocated to the chamber (6) can be released by moving the lid element (4) relative to the inner housing (5), so that a medium stored in the chamber (6) can exit into the into container (2), and the chamber (6) and inner housing (5) each have corresponding first threads (10) formed relative to a rotational thread axis (19), wherein the chamber (6) extends laterally above the first threaded means (10) until over the first threaded means (10), wherein the chamber (6) is welded to the lid element (4), wherein the chamber (6) has a connecting flange defining an opening before welding, the connecting flange being aligned essentially parallel to an adjacent surface of the lid element, and wherein the chamber is connected with the lid element along the resultant annularly formed region.

10. A closure device (1) for a container (2), in particular a glass container, with a container opening (3), wherein the closure device (1) has a lid element (4) for closing the container opening (3), a chamber (6) arranged between the lid element (4) and an inner housing (5), wherein the chamber (6) and inner housing (5) have mutually corresponding closure means (7) and opening means (9), which interact with each other in such a way that a discharge opening (8) allocated to the chamber (6) can be released by moving the lid element (4) relative to the inner housing (5), so that a medium stored in the chamber (6) can exit into the into container (2), and the chamber (6) and inner housing (5) each have corresponding first threads (10) formed relative to a rotational thread axis (19), wherein the closure means (7) in a sealing plane has a soft plastic (20) radially outward and a rigid plastic (21) radially inward, and wherein a front surface of the closure means (7) facing a tank interior consists entirely or partially of the soft plastic (20).

* * * * *